US007452832B2

(12) United States Patent
Bansal et al.

(10) Patent No.: US 7,452,832 B2
(45) Date of Patent: Nov. 18, 2008

(54) FULL-SURFACE BONDED MULTIPLE COMPONENT MELT-SPUN NONWOVEN WEB

(75) Inventors: Vishal Bansal, Richmond, VA (US); Hyun Sung Lim, Midlothian, VA (US); David Matthews Laura, Jr., Old Hickory, TN (US)

(73) Assignee: E.I. du Pont de Nemors and Company, Wilmington, DE (US)

( * ) Notice: Subject to any disclaimer, the term of this patent is extended or adjusted under 35 U.S.C. 154(b) by 102 days.

(21) Appl. No.: 11/007,980

(22) Filed: Dec. 9, 2004

(65) Prior Publication Data

US 2005/0130545 A1 Jun. 16, 2005

Related U.S. Application Data

(60) Provisional application No. 60/529,997, filed on Dec. 15, 2003.

(51) Int. Cl.

| | |
|---|---|
| ***D04H 1/00*** | (2006.01) |
| ***D04H 13/00*** | (2006.01) |
| ***D04H 3/03*** | (2006.01) |
| ***D04H 5/00*** | (2006.01) |

(52) U.S. Cl. ..... 442/361; 442/362; 442/364; 442/381; 442/382; 442/394; 442/401; 442/415

(58) Field of Classification Search ..... 442/361, 442/362, 364, 381, 382, 394, 401, 415
See application file for complete search history.

(56) References Cited

U.S. PATENT DOCUMENTS

| | | | | |
|---|---|---|---|---|
| 5,108,827 | A | 4/1992 | Gessner | |
| 5,308,691 | A | 5/1994 | Lim et al. | |
| 5,554,442 | A * | 9/1996 | Matsunaga et al. | 428/373 |
| 5,589,258 | A | 12/1996 | Maddern et al. | |
| 5,851,355 | A * | 12/1998 | Goettmann | 162/157.3 |
| 5,972,145 | A | 10/1999 | Holmes et al. | |
| 5,972,147 | A * | 10/1999 | Janis | 156/181 |
| 6,548,431 | B1 | 4/2003 | Bansal et al. | |
| 6,758,839 | B2 * | 7/2004 | Lochte et al. | 604/385.18 |
| 6,831,025 | B2 * | 12/2004 | Rudisill et al. | 442/401 |
| 2003/0003826 | A1 * | 1/2003 | Rudisill et al. | 442/36 |
| 2003/0171054 | A1 * | 9/2003 | Bansal | 442/361 |

FOREIGN PATENT DOCUMENTS

| | | |
|---|---|---|
| GB | 1 407 032 | 9/1975 |
| WO | WO 95/09728 | 4/1995 |
| WO | WO 01/46507 A1 | 6/2001 |
| WO | WO 01/49914 A1 | 7/2001 |
| WO | WO 02/057528 A2 | 7/2002 |

* cited by examiner

*Primary Examiner*—Norca Torres-Velazquez

(57) ABSTRACT

A full-surface bonded multiple component nonwoven fabric is provided that has an improved combination of tear strength and tensile strength at lower thicknesses than known in the art. The full-surface bonded multiple component webs have a void percent between about 3% and 56% and a Frazier permeability of at least 0.155 $m^3$/min-$m^2$. The full-surface bonded multiple component nonwoven fabrics can be prepared in a smooth-calendering process.

19 Claims, 1 Drawing Sheet

FULL-SURFACE BONDED MULTIPLE COMPONENT MELT-SPUN NONWOVEN WEB

BACKGROUND OF THE INVENTION

This invention relates to full-surface bonded nonwoven fabrics that comprise at least 50 weight percent multiple component fibers. The full-surface bonded nonwoven fabrics are bonded at temperatures lower than those generally used in the art and have improved strength and tear properties at lower thickness for a given basis weight than full-surface bonded materials known in the art.

Spunbond nonwoven fabrics formed from continuous multiple component sheath-core fibers that comprise a sheath polymer that melts at a lower temperature than the core polymer are known in the art. For example, Bansal et al. U.S. Pat. No. 6,548,431 describes nonwoven sheets comprised of at least 75 weight percent of melt spun substantially continuous multiple component fibers that are at least 30% by weight poly(ethylene terephthalate) having an intrinsic viscosity of less than 0.62 dl/g. The substantially continuous multiple component fibers can be sheath-core fibers. The nonwoven webs can be bonded by thermal bonding at temperatures within plus or minus 20° C. of the melting point of the lowest melting temperature polymer in the web.

Sheath-core staple fibers that comprise a sheath polymer having a lower melting point than the core polymer are known in the art for use as binder fibers. Binder fibers are staple fibers that can be used alone or in blends with other staple fibers to form a nonwoven web that can be bonded by heating to a temperature that is sufficient to activate the binder fibers, causing the surface of the binder fibers to adhere to adjacent fibers.

It is also known to form thermally-bonded nonwoven fabrics that comprise fibers made from blends of a lower melting polymer and a higher melting polymer. Gessner U.S. Pat. No. 5,108,827 describes a thermally-bonded nonwoven fabric comprising multiconstituent fibers composed of a highly dispersed blend of at least two different immiscible thermoplastic polymers that has a dominant continuous polymer phase and at least one non-continuous phase dispersed therein. The polymer of the non-continuous phase has a polymer melt temperature at least 30° C. below the polymer melt temperature of the continuous phase and the fiber is configured such that the non-continuous phase occupies a substantial portion of the fiber surface.

Nonwoven webs can be thermally bonded using methods known in the art, including intermittent point or pattern bonding, and smooth calendering. Point or pattern bonding can be achieved by applying heat and pressure at discrete areas on the surface of the web, for example by passing the web through a nip formed by a patterned calender roll and a smooth roll, or between two patterned rolls. One or both of the rolls are heated to thermally bond the fabric at distinct points, lines, areas, etc. on the fabric surface. Intermittently bonded nonwovens are especially suitable for end uses where high air permeability and comfort are desirable attributes. However, they do not have sufficiently high strength for certain end uses. In certain cases, it may be preferred that the nonwoven web bonded with a smoother finish. This can be achieved in a smooth calendering process wherein a nonwoven web is bonded by passing it through a nip formed between two smooth rolls, at least one of which is heated. For nonwoven webs comprising thermoplastic polymeric fibers, smooth calendering and point bonding are generally conducted at temperatures approaching the melting point of the lowest melting polymer in the nonwoven web.

Maddern et al. U.S. Pat. No. 5,589,258 describes spunbond-meltblown laminates that have been treated with a thermal stabilizing agent, such as a fluorocarbon, and thermal pattern bonded followed by smooth calendering. Smooth calendering is conducted by passing the material through a nip of a smooth heated roller and a non-heated roller. Preferably the roller is heated to a temperature substantially the same as the melting point of the polymer of the fibers in the nonwoven layer to be calendered. It is thought that the presence of the thermal stabilizing agent allows some flowing of the polymer comprising the fibers and results in fiber-to-fiber bonding but retards complete film formation compared to untreated material calendered under identical conditions. Such a process requires high calendering temperatures compared to the calendering temperatures used in the present invention as well as the use of a thermal stabilizing agent. Use of such stabilizing agents may not be desirable for certain end uses and requires a separate treatment step to apply the thermal stabilizing agent in addition to the thermal bonding step.

Lim et al. U.S. Pat. No. 5,308,691 describes calendered polypropylene spunbonded/meltblown laminates suitable for use as housewrap or sterile packaging. The composite spunbonded sheet is bonded in a calender comprising a smooth metal roll heated to a temperature of 140° C. to 170° C., operating against an unheated, resilient roll, at a nip loading of about $1.75\times10^{-5}$ to $3.5\times10^{-5}$ N/m.

Duncan et al. PCT International Publication Number WO 01/49914 describes thermal calendering of a spunlaid nonwoven at a temperature that is lower then the melting point of the material from which the nonwoven has been made, for example lower than the softening point of that material and/or at a pressure below that normally used for that material. Such webs have low strength and are preferably minimally bonded to a point sufficient only to provide for base web integrity prior to entanglement with a second web.

There remains a need for low-cost nonwoven fabrics that are smooth and relatively thin while retaining significant tensile strength and tear strength.

BRIEF SUMMARY OF THE INVENTION

In one embodiment, the invention is directed to a full-surface bonded multiple component nonwoven fabric comprising a full-surface bonded nonwoven sheet having at least 50 weight percent melt-spun multiple component fibers selected from the group consisting of multiple component staple fibers, multiple component continuous fibers, and combinations thereof, the multiple component fibers having a cross-section and a length, and comprising a first polymeric component and a second polymeric component, the first and second polymeric components being arranged in substantially constantly positioned distinct zones across the cross-section of the multiple component fibers and extending substantially continuously along the length of the multiple component fibers, wherein the second polymeric component has a melting point that is at least about 10° C. lower than the melting point of the first polymeric component and wherein at least a portion of the outer peripheral surface of the multiple component filaments comprises the second polymeric component, a ratio of average strip tensile strength to basis weight of at least 1.05 N/gsm, and a ratio of average trap tear strength to basis weight of at least 0.329 N/gsm.

In a second embodiment, this invention is directed to a process for preparing a thermally bonded multiple component nonwoven fabric comprising the steps of: (a) providing a multiple component nonwoven fabric having a first outer surface and an opposing second outer surface, the multiple component nonwoven fabric comprising at least 50 weight percent multiple component melt-spun fibers selected from the group consisting of multiple component staple fibers, multiple component continuous fibers, and combinations thereof, the multiple component fibers having a cross-section and a length, the multiple component fibers comprising a first polymeric component and a second polymeric component, the first and second polymeric components being arranged in substantially constantly positioned distinct zones across the cross-section of the multiple component fibers and extending substantially continuously along the length of the multiple component fibers, wherein the second polymeric component has a melting point, $T_m$, that is at least about 10° C. lower than the melting point of first polymeric component and at least a portion of the outer peripheral surface of the multiple component filaments comprises the second polymeric component; (b) pre-heating the first outer surface of the multiple component nonwoven fabric to a temperature between 35° C. and ($T_m$-40)° C.; (c) full-surface bonding the first outer surface of the multiple component nonwoven fabric by passing the pre-heated nonwoven fabric through a first nip formed by first and second smooth-surfaced calender rolls wherein the second roll is unheated and the first roll contacts the first outer surface of the nonwoven fabric and is maintained at a temperature no greater than ($T_m$-40)° C., while applying a first nip pressure between about 17.5 to about 70 N/mm; (d) optionally, pre-heating the second outer surface of the multiple component nonwoven fabric to a temperature between 35° C. and ($T_m$-40)° C.; and (e) full-surface bonding the second outer surface of the nonwoven fabric by passing the twice pre-heated nonwoven fabric through a second nip formed by third and fourth smooth-surfaced calender rolls wherein the fourth roll is unheated and the third roll contacts the second outer surface of the nonwoven fabric and is maintained at a temperature no greater than ($T_m$-40)° C., while applying a second nip pressure between about 17.5 to about 70 N/mm.

DETAILED DESCRIPTION OF THE INVENTION

Figure 1:
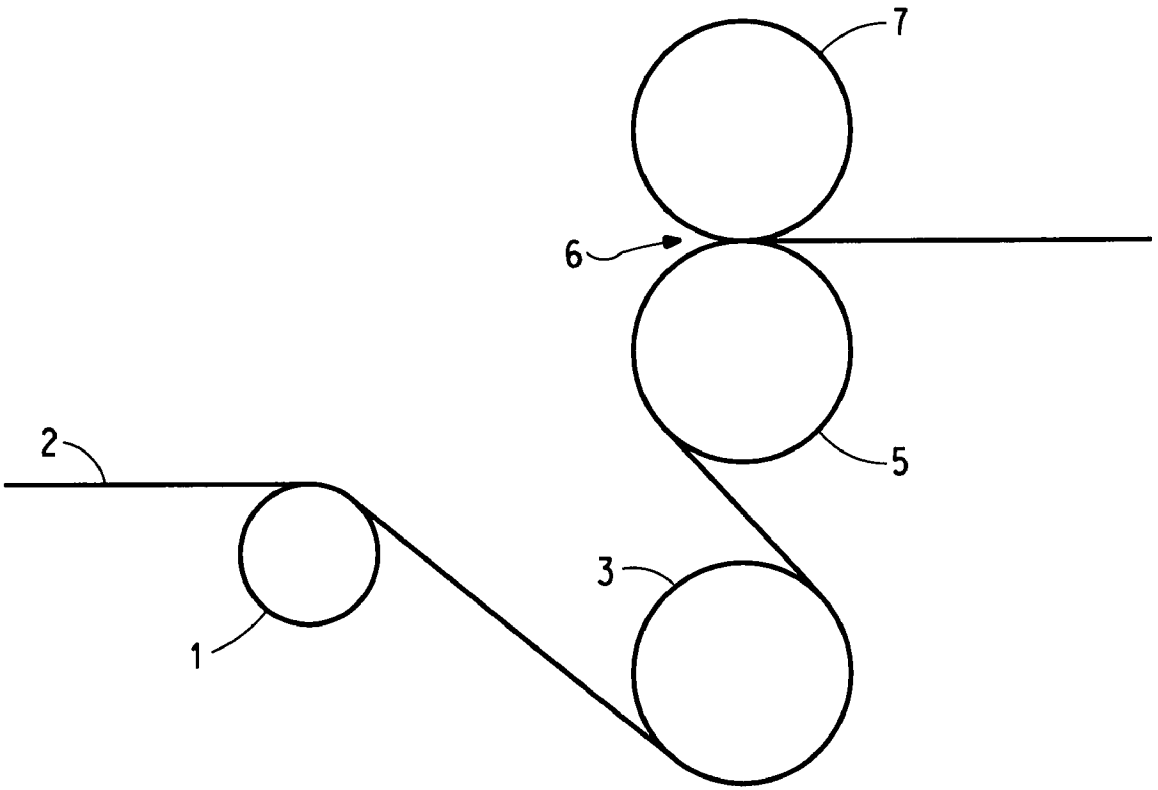
FIG. 1 is a schematic drawing of a process suitable for preparing a full-surface bonded nonwoven fabric of the present invention.

The present invention is directed to a full-surface bonded multiple component nonwoven fabric comprising a full-surface bonded nonwoven sheet having at least 50 weight percent melt-spun multiple component fibers. The melt-spun multiple component fibers are selected from the group consisting of multiple component staple fibers, multiple component continuous fibers, and combinations thereof. The full-surface bonded nonwoven fabric is prepared by heating a multiple component nonwoven web while applying pressure to the web between two smooth surfaces at temperatures that are lower than those used in the art for calendering nonwovens comprised predominantly of thermoplastic fibers. Surprisingly, despite the lower bonding temperatures, the full-surface bonded multiple component nonwoven webs of the present invention have an improved combination of ratios of average trapezoidal tear strength to basis weight and average grab tensile strength to basis weight while remaining air permeable.

The terms "full-surface bonded nonwoven fabric" or "smooth calendered nonwoven fabric" as used herein refer to a nonwoven fabric that has been bonded by applying heat and pressure to the nonwoven fabric between two substantially smooth bonding surfaces. A full-surface bonded nonwoven fabric is bonded over substantially 100% of its outer surfaces by fiber-to-fiber bonds. The use of smooth bonding surfaces results in each side of the full-surface bonded nonwoven fabric being substantially uniformly bonded.

The term "copolymer" as used herein includes random, block, alternating, and graft copolymers prepared by polymerizing two or more comonomers and thus includes dipolymers, terpolymers, etc.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. Examples of polyesters include poly(ethylene terephthalate) (PET) which is a condensation product of ethylene glycol and terephthalic acid and poly(1,3-propylene terephthalate) which is a condensation product of 1,3-propanediol and terephthalic acid.

The term "polyamide" as used herein is intended to embrace polymers containing recurring amide (—CONH—) groups. One class of polyamides is prepared by copolymerizing one or more dicarboxylic acids with one or more diamines. Examples of polyamides suitable for use in the present invention include poly(hexamethylene adipamide) (nylon 6,6) and polycaprolactam (nylon 6).

The terms "nonwoven fabric, sheet, layer or web" as used herein means a structure of individual fibers, filaments, or threads that are positioned in a random manner to form a planar material without an identifiable pattern, as opposed to a knitted or woven fabric. Examples of nonwoven fabrics include meltblown webs, spunbond webs, carded webs, air-laid webs, wet-laid webs, and spunlaced webs and composite webs comprising more than one nonwoven layer.

The term "multi-layer composite sheet" as used herein refers to a multi-layer structure comprising at least first and second sheet-like layers wherein at least the first layer is a nonwoven fabric. The second layer can be a nonwoven fabric (same as or different than the first layer), woven fabric, knitted fabric, or a film.

The term "machine direction" (MD) is used herein to refer to the direction in which a nonwoven web is produced (e.g. the direction of travel of the supporting surface upon which the fibers are laid down during formation of the nonwoven web). The term "cross direction" (XD) refers to the direction generally perpendicular to the machine direction in the plane of the web.

The term "spunbond fibers" as used herein means fibers that are melt-spun by extruding molten thermoplastic polymer material as fibers from a plurality of fine, usually circular, capillaries of a spinneret with the diameter of the extruded fibers then being rapidly reduced by drawing and then quenching the fibers. Other fiber cross-sectional shapes such as oval, tri-lobal, multi-lobal, flat, hollow, etc. can also be used. Spunbond fibers are generally substantially continuous and usually have an average diameter of greater than about 5 micrometers. Spunbond nonwoven webs are formed by laying spunbond fibers randomly on a collecting surface such as a foraminous screen or belt.

The term "meltblown fibers" as used herein, means fibers that are melt-spun by meltblowing, which comprises extruding a melt-processable polymer through a plurality of capillaries as molten streams into a high velocity gas (e.g. air) stream. The high velocity gas stream attenuates the streams of molten thermoplastic polymer material to reduce their diameter and form meltblown fibers having a diameter between about 0.5 and 10 micrometers. Meltblown fibers are generally discontinuous fibers but can also be continuous. Meltblown fibers carried by the high velocity gas stream are generally deposited on a collecting surface to form a meltblown web of randomly dispersed fibers. Meltblown fibers can be tacky when they are deposited on the collecting surface, which generally results in bonding between the meltblown fibers in the meltblown web. Meltblown webs can also be bonded using methods known in the art, such as thermal bonding.

The term "spunbond-meltblown-spunbond nonwoven fabric" (SMS nonwoven fabric) as used herein refers to a multilayer composite sheet comprising a web of meltblown fibers sandwiched between and bonded to two spunbond layers. A SMS nonwoven fabric can be formed in-line by sequentially depositing a first layer of spunbond fibers, a layer of meltblown fibers, and a second layer of spunbond fibers on a moving porous collecting surface. The assembled layers can be bonded by passing them through a nip formed between two rolls that can be heated or unheated and smooth or patterned. Alternately, the individual spunbond and meltblown layers can be pre-formed and optionally bonded and collected individually such as by winding the fabrics on wind-up rolls. The individual layers can be assembled by layering at a later time and bonded together to form a SMS nonwoven fabric. Additional spunbond and/or meltblown layers can be incorporated in the SMS nonwoven fabric, for example spunbond-meltblown-meltblown-spunbond (SMMS), etc.

The term "multiple component fiber" as used herein refers to a fiber that is composed of at least two distinct polymeric components that have been spun together to form a single fiber. The at least two polymeric components are arranged in distinct substantially constantly positioned zones across the cross-section of the multiple component fibers, the zones extending substantially continuously along the length of the fibers. The multiple component spunbond fibers can be bicomponent fibers, which are made from two distinct polymer components. An example of a bicomponent cross-section known in the art is a sheath-core cross-section. Sheath-core fibers have a cross-section in which the core component is positioned in the interior of the fiber and extends substantially the entire length of the fiber and is surrounded by the sheath component such that the sheath component forms the outer peripheral surface of the fiber. Another bicomponent cross-section known in the art is a side-by-side cross-section in which the first polymeric component forms at least one segment that is adjacent at least one segment formed of the second polymeric component, each segment being substantially continuous along the length of the fiber with both polymers exposed on the fiber surface. Multiple component fibers are distinguished from fibers that are extruded from a single homogeneous or heterogeneous blend of polymeric materials. However, one or more of the distinct polymeric components used to form the multiple component fibers can comprise a blend of two or more polymeric materials. For example, sheath-core fibers can comprise a sheath that is made from a first blend of at least two different polymeric materials and/or a core that is made from a second blend of at least two different polymeric materials wherein the overall composition of the sheath is different than the overall composition of the core. The term "multiple component nonwoven web" as used herein refers to a nonwoven web comprising multiple component fibers. The term "bicomponent web" as used herein refers to a nonwoven web comprising bicomponent fibers. A multiple component web can comprise both multiple component and single component fibers.

The nonwoven fabrics of the present invention are prepared by full-surface bonding nonwoven webs comprising at least 50 weight percent of melt-spun thermoplastic polymeric multiple component fibers. The multiple component fibers can be discontinuous (staple) fibers, continuous fibers, or a combination thereof. In one embodiment, the nonwoven fabric consists essentially of continuous multiple component fibers such as a spunbond nonwoven fabric. In another embodiment, the nonwoven fabric comprises a SMS nonwoven fabric wherein one or both of the spunbond layers comprises multiple component fibers. In one such embodiment, both spunbond layers consist essentially of continuous multiple component spunbond fibers.

Staple-based nonwovens can be prepared by a number of methods known in the art, including carding or garneting, air-laying, or wet-laying of fibers, including melt-spun fibers. The staple fibers preferably have a denier per filament between about 0.5 and 6.0 and a fiber length of between about 0.25 inch (0.6 cm) and 4 inches (10.1 cm).

Continuous filament nonwoven webs can be prepared using methods known in the art such as spunbonding. The continuous filament webs suitable for preparing the nonwoven fabrics of the present invention preferably comprise continuous filaments having a denier per filament between about 0.5 and 20, more preferably between about 1 and 5. Multiple component spunbond webs suitable for preparing the full-surface bonded nonwoven fabrics of the present invention can be prepared using spunbonding methods known in the art, for example as described in Bansal et al. U.S. Pat. No. 6,548,431, which is hereby incorporated by reference. The multiple component spunbond process can be performed using one or more pre-coalescent dies, wherein the distinct polymeric components are contacted prior to extrusion from the extrusion orifice, or one or more post-coalescent dies, in which the distinct polymeric components are extruded through separate extrusion orifices and are contacted after exiting the capillaries to form the multiple component fibers.

Multiple component fibers suitable for preparing the nonwoven fabrics of the present invention can have the polymeric components arranged in side-by-side, sheath-core, or other multiple component fiber cross-section known in the art. The outer peripheral surface of the multiple component fibers at least partially comprises the lowest-melting polymeric component. For example, when the polymeric components are arranged in a sheath-core configuration, the sheath comprises the lower-melting polymeric component and the core comprises the higher-melting component. In one embodiment, the multiple component fibers comprise bicomponent sheath-core fibers wherein the bicomponent fibers comprise between about 5 and 60 weight percent of a lower-melting sheath component and between about 40 and 95 weight percent of a higher-melting core component. More preferably, the bicomponent fibers comprise between about 15 and 40 weight percent of the sheath component and between about 60 and 85 weight percent of the core component. The lower- or lowest-melting polymeric component preferably has a melting point that is at least 10° C. lower than the melting point of the higher- or highest-melting component, and more preferably has a melting point that is at least 20° C. lower than the melting point of the higher- or highest melting component. The lower- or lowest-melting polymeric component preferably has a melting point of at least 120° C., allowing the full-surface bonded multiple component nonwoven fabric to be processed and/or used at elevated temperatures without significant loss of strength.

Polymers suitable for use as the lower- or lowest-melting polymer component include polyesters such as poly(ethylene terephthalate) copolymers, poly(1,4-butylene terephthalate) (4GT), and poly(1,3-propylene terephthalate) (3GT), and polyamides such as polycaprolactam (nylon 6). Polymers suitable for use as the higher- or highest-melting polymeric component include polyesters such as poly(ethylene terephthalate) (2GT) and polyamides such as poly(hexamethylene adipamide) (nylon 6,6).

In one embodiment, the higher- or highest-melting polymeric component comprises poly(ethylene terephthalate) having a starting intrinsic viscosity in the range of 0.4 to 0.7 dl/g (measured according to ASTM D 2857, using 25 vol. % trifluoroacetic acid and 75 vol. % methylene chloride at 30° C. in a capillary viscometer), more preferably 0.55 to 0.68 dl/g.

In another embodiment, the lower- or lowest-melting polymeric component consists essentially of a polymer selected from the group consisting of poly(ethylene terephthalate) copolymers, poly(1,4-butylene terephthalate), and poly(1,3-propylene terephthalate), and polycaprolactam and the highest-melting polymeric component consists essentially of a polymer selected from the group consisting of poly(ethylene terephthalate) and poly(hexamethylene adipamide).

Poly(ethylene terephthalate) copolymers suitable for use as the lower- or lowest-melting polymeric component in the multiple component nonwoven fabrics of the present invention include amorphous and semi-crystalline poly(ethylene terephthalate) copolymers. For example, poly(ethylene terephthalate) copolymers in which between about 5 and 30 mole percent based on the diacid component is formed from di-methyl isophthalic acid, as well as poly(ethylene terephthalate) copolymers in which between about 5 and 60 mole percent based on the glycol component is formed from 1,4-cyclohexanedimethanol are suitable for use as the lower- or lowest-melting component in the multiple component fibers. Poly(ethylene terephthalate) copolymers that have been modified with 1,4-cyclohexanedimethanol are available from Eastman Chemicals (Kingsport, Tenn.) as PETG copolymers. Poly(ethylene terephthalate) copolymers that have been modified with di-methyl isophthalic acid are available from E. I. du Pont de Nemours and Company (Wilmington, Del.) as Crystar® polyester copolymers.

One or more of the polymeric components used to form the multiple component fibers can be a blend of two or more polymers. When a blend of polymers exhibits more than one melting point, the melting point of a blend is taken to be the lowest of the melting points measured for the blend. Polymer blends can be prepared by methods known in the art including mixing extruders, Brabender mixers, Banbury mixers, roll mills, etc. A melt blend can be extruded and the extrudate cut to form pellets, which can be fed to the spinning process. Alternately, pellets of the individual polymers forming the blend can be dry blended and fed as a blend of pellets to the spinning process or pellets of one of the polymers forming the blend can be added to a molten stream of another polymer in an extruder using an additive feeder in the spinning process.

The polymeric components forming the multiple component fibers can include conventional additives such as dyes, pigments, antioxidants, ultraviolet stabilizers, spin finishes, and the like.

The full-surface bonded multiple component nonwoven webs of the present invention can have a void percent between about 3% and 56%, a ratio of average strip tensile strength to basis weight of at least 1.05 N/(g/m$^2$), a Frazier air permeability of at least 0.155 m$^3$/min-m$^2$ preferably at least 0.310 m$^3$/min-m$^2$, and a ratio of average trap tear strength to basis weight of at least 0.329 N/(g/M$^2$). In one embodiment, the full-surface bonded multiple component nonwoven webs of the present invention can have a void percent between about 35% and 55%. The void percent of the full-surface bonded multiple component webs of the present invention is higher than that of film-like structures that can form when full-surface bonding a nonwoven material using high calendering temperatures and is lower than the void percent of point-bonded nonwoven webs, which typically have a void percent of greater than 80%. The void percent can be calculated from the basis weight and thickness of the nonwoven web and the density of the fibers using the formula given in the test methods below. For the nonwoven fabrics prepared in the examples below which consist of sheath-core fibers consisting of 40 weight percent poly(ethylene terephthalate) copolymer sheath and 60 weight percent poly(ethylene terephthalate) core, a void percent of 3% to 56% corresponds to a ratio of thickness to basis weight of between about 0.00068 mm/gsm to 0.0015 mm/gsm, where "gsm" is g/m$^2$.

The full-surface bonded multiple component nonwoven webs of the present invention are prepared by bonding a multiple-component melt-spun nonwoven web by applying heat and pressure to the web between two substantially parallel smooth bonding surfaces. The bonding pressure is preferably between about 17.5 to 70 N/mm. The smooth bonding surfaces are maintained at a temperature that is no greater than ($T_m$-40° C.), where $T_m$ is the melting point of the lowest melting polymeric component, and sufficiently high to yield full-surface bonded nonwoven fabrics having the desired properties described above. Prior to full-surface bonding the web between two smooth surfaces, the web is preferably pre-heated. Pre-heating the web can be achieved by contacting the web with a heated surface such as a heated roll prior to full-surface bonding. Alternately, the web can be pre-heated by blowing heated gas such as heated air on or through the web, or through the use of infrared radiation or other heating means. Generally, pre-heating and bonding temperatures greater than about 35° C. and no greater than ($T_m$-40)° C. are suitable. In one embodiment, the pre-heating temperature is the same as the full-surface bonding temperature.

In one embodiment of the present invention, a full-surface bonded multiple component nonwoven fabric is prepared using the smooth-calendering process shown in FIG. 1. Multiple component nonwoven sheet 2 is passed over change-of-direction roll 1 and partially wrapped around pre-heating roll 3 to optionally pre-heat the first side of the nonwoven sheet to a temperature between 35° C. and ($T_m$-40)° C. prior to passing the spunbond nonwoven fabric through a nip 6 formed by substantially smooth calender rolls 5 and 7. One or both of calender rolls 5 and 7 are heated to a temperature that is no greater than ($T_m$-40)° C. and sufficiently high to provide the desired nonwoven fabric properties. In one embodiment, calender roll 5 is a heated metal roll and calender roll 7 is an unheated backing roll. The backing roll preferably has a resilient surface, for example a resilient material having a Shore D hardness between about 75-90. For example, densely packed cotton, wool, or polyamide rolls are suitable. The hardness of the resilient backing roll determines the "footprint", i.e. the instant area being calendered. If the hardness is reduced, the contact area is increased and the pressure decreases. When the process depicted in FIG. 1 is used, the nonwoven fabric is passed through the process twice with the fabric inverted in the second pass to bond the second side of the fabric.

Other calender roll configurations can be used to make the full-surface bonded nonwoven fabrics of the present invention. For example, heated calender roll 5 and unheated calender roll 7 can be reversed such that the pre-heated side of the fabric contacts heated calender roll 5. An additional set of pre-heating roll and smooth calender rolls can be added in series with the pre-heating roll and smooth calender rolls shown in FIG. 1 so that both surfaces are full-surface bonded without the need to make a second pass through the calender. For example, the multiple component nonwoven web can be full-surface bonded in a process in which a first outer surface of the web is pre-heated to a temperature between 35° C. and ($T_m$-40)° C. by contacting the first surface of the web with a pre-heating roll and then full-surface bonding the first surface by passing the pre-heated nonwoven fabric through a first nip formed by first and second smooth-surfaced calender rolls wherein the second calender roll is unheated and the first calender roll contacts the first outer surface of the nonwoven fabric and is maintained at a temperature no greater than ($T_m$-40)° C. and sufficiently high to provide a full-surface bonded multiple component nonwoven fabric having the properties recited above, while applying a first nip pressure between about 17.5 to about 70 N/mm, followed by pre-heating the second outer surface of the multiple component nonwoven fabric to a temperature between 35° C. and ($T_m$-40)° C. by contacting the second outer surface with a second pre-heating roll and then full-surface bonding the second outer surface of the nonwoven fabric by passing the twice pre-heated nonwoven fabric through a second nip formed by third and fourth smooth-surfaced calender rolls wherein the fourth roll is unheated and the third roll contacts the second outer surface of the nonwoven fabric and is maintained at a temperature no greater than ($T_m$-40)° C. but high enough to provide a full-surface bonded multiple component nonwoven fabric having the properties recited above, while applying a second nip pressure between about 17.5 to about 70 N/mm. Alternately, the multiple component nonwoven web can be pre-heated on both sides simultaneously by passing the web through a first nip formed by two heated pre-heating rolls and full-surface bonded by either (a) passing the pre-heated web through a second nip formed by two smooth calender rolls with a second nip pressure between about 17.5 and 70 N/mm, each of the smooth calender rolls being heated to a temperature no greater than ($T_m$-40)° C. but high enough to provide a full-surface bonded multiple component nonwoven fabric having the properties recited above or (b) passing the pre-heated web through a second nip formed by first and second smooth calender rolls wherein the first roll is heated to a temperature no greater than ($T_m$-40)° C. and contacts a first surface of the pre-heated web and the second roll is unheated and then through a third nip formed by third and fourth smooth calender rolls wherein the third roll is heated to a temperature no greater than ($T_m$-40)° C. and contacts the second surface of the web and the fourth roll is unheated. The first and third rolls are heated to a temperature that is sufficient to provide a full-surface bonded multiple component nonwoven fabric having the properties recited above and the nip pressure in the second and third nips is between about 17.5 and 70 N/mm. Other smooth-calendering methods known in the art can be used to full-surface bond the multiple component melt-spun nonwoven webs so long as the temperatures and pressures are maintained within the ranges described above to provide a full-surface bonded web having the combination of properties described above. An alternate calendering process is described in Janis U.S. Pat. No. 5,972,147, which is hereby incorporated by reference. Although this patent describes a method for bonding polyolefin fibrous sheets, the roll configurations described can be adapted to make the full-surface bonded multiple component nonwoven materials of the present invention.

The primary operating parameters of the calendering process are line speed, temperature, and pressure which can be adjusted to achieve the desired properties. If the calendering temperature is too high, the lowest-melting polymeric component in the nonwoven web can melt and flow to form a film-like structure with little or no air permeability and low tear strength. Such structures may also be brittle and prone to cracking. If the calendering speed is too high and the temperature is too low, the web will be insufficiently bonded and have low strength. The pre-heating step reduces the heat load on the calender. The multiple component nonwoven webs are preferably full-surface bonded using bonding surfaces such as calender rolls with a calendering pressure between about 17.5 and 70 N/mm. At pressures lower than 17.5 N/mm, the sheets can be less than fully bonded and at calendering pressures higher than 70 N/mm, the sheets can have low tear strength. Line speeds between about 10 and 400 m/min can be used. The line speed can be adjusted to give the desired combination of properties for a given calendering temperature and pressure.

Although calendering of nonwoven sheets is generally performed using a continuous roll-to-roll process, it can also be done in a continuous process using heated and pressurized belts. Alternately, samples of a multiple component nonwoven sheet can be full-surface bonded in a hot press or other equipment wherein the nonwoven sheet is sandwiched between two substantially smooth and parallel surfaces, at least one of which is heated, while applying pressure under conditions which yield the desired nonwoven web properties described above.

Prior to full-surface bonding, the multiple component nonwoven webs used to make the full-surface bonded nonwoven fabrics of the present invention can be pre-bonded by intermittent thermal bonding methods known in the art. For example, the spunbond web can be thermally bonded with a discontinuous pattern of points, lines, or other pattern of intermittent bonds using methods known in the art followed by a full-surface bonding process such as one of the processes described above. Intermittent thermal bonds can be formed by applying heat and pressure at,discrete spots on the surface of the spunbond web, for example by passing the layered structure through a nip formed by a patterned calender roll and a smooth roll or two patterned rolls wherein at least one of the rolls is heated, or a horn and a rotating patterned anvil roll in an ultrasonic bonding process. Alternately, the multiple component webs can be pre-bonded using through-air bonding methods known in the art, wherein heated gas such as air is passed through the fabric at a temperature sufficient to bond the fibers together where they contact each other at their cross-over points while the fabric is supported on a porous surface. Pre-bonding prior to full-surface bonding may be desirable to give the fabric sufficient strength to be handled in subsequent processing, for example allowing it to be wound on a roll and unwound at a later time for use in a full-surface bonding process. Alternately, the multiple component nonwoven web can be full-surface bonded in a continuous process during web formation. For example, a multiple component melt-spun web can be full-surface bonded in-line in a spunbond or SMS process by passing the web between heated smooth calender rolls after laydown but prior to being wound on a roll.

The full-surface bonded melt spun multiple component nonwoven webs of the present invention can be combined with one or more additional sheet-like layers to form a multilayer composite sheet. The one or more additional sheet-like layers can be bonded to one or more of the full-surface bonded webs of the present invention in a thermal bonding process or through the use of an adhesive or extruded tie layer. For example, the full-surface bonded multiple component web of the present invention can be bonded to one or more additional layers selected from the group consisting of meltblown nonwoven webs, spunbond nonwoven webs, carded nonwoven webs, air-laid nonwoven webs, wet-laid nonwoven webs, spunlaced nonwoven webs, knit fabrics, woven fabrics, and films. For example, the multiple component spunbond fabric can be bonded to a breathable microporous film. Microporous films are well known in the art, such as those formed from a polyolefin (e.g. polyethylene) film containing particulate fillers.

The high tensile and tear strengths of the full-surface bonded multiple component nonwoven fabrics of the present inventions make them especially suitable for use in child-resistant packaging. In one embodiment, one or more full-surface bonded multiple component webs of the present invention is bonded to a barrier layer and used as the lidding component in blister packaging. For example, a child-resistant blister package can be formed by heat-sealing a lidding component comprising a full-surface bonded multiple component nonwoven sheet of the present invention to a blister component. The lidding component can further comprise a barrier layer, an optional adhesive tie layer intermediate the full-surface bonded nonwoven fabric and barrier layer, and a heat-seal layer on the side of the barrier layer opposite the full-surface bonded nonwoven fabric for heat-sealing the lidding component to the blister component. The high tensile and tear strength of the full-surface bonded melt-spun nonwoven webs imparts a high degree of resistance to opening of or damaging of the package by children. The full-surface bonded multiple component nonwoven fabrics are also suitable in other uses which require a combination of high strength, tear resistance, and air permeability.

In another embodiment of a multi-layer composite sheet is prepared by thermally bonding a full-surface bonded multiple component spunbond web of the present invention to a meltblown web. Alternately, a SMS nonwoven fabric can be formed wherein at least one of the spunbond layers comprises a full-surface bonded multiple component spunbond web of the present invention. The meltblown web can be a single component meltblown web or a multiple component meltblown web. In one embodiment, a multi-layer composite sheet is formed by sandwiching a bicomponent meltblown web between two full-surface bonded multiple component spunbond webs of the present invention and bonding the layers together. In one such embodiment, the bicomponent meltblown web is comprised of meltblown fibers having a substantially side-by-side configuration comprising a polyester copolymer component and a polyester (e.g. poly(ethylene terephthalate) component and the multiple component spunbond web comprises continuous melt-spun sheath-core fibers wherein the sheath component comprises a polyester copolymer and the core component comprises a polyester (e.g. poly(ethylene terephthalate). The spunbond nonwoven layers can be full-surface bonded prior to bonding to the meltblown layer. Alternately, a SMS, SMMS, etc. nonwoven sheet can be formed first and then full-surface bonded using one of the methods described above, either in-line after lay-down of the layers forming the SMS, SMMS, etc. nonwoven sheet, or in a separate full-surface bonding process. If the nonwoven sheet is full-surface bonded in later processing, it may be desirable to lightly pre-bond the nonwoven sheet to provide sufficient strength to withstand further processing, as described above.

Test Methods

In the description above and in the examples that follow, the following test methods were employed to determine various reported characteristics and properties. ASTM refers to the American Society for Testing and Materials.

Basis Weight is a measure of the mass per unit area of a fabric or sheet and was determined by ASTM D-3776, which is hereby incorporated by reference, and is reported in $g/m^2$ (gsm).

Strip Tensile Strength is a measure of the breaking strength of a sheet and was measured according to ASTM D5035, which is hereby incorporated by reference, and is reported in Newtons. The strip tensile strength was measured for 5 samples in both the machine direction and the cross-direction. The average MD and average XD tensile strengths were calculated and then averaged to obtain the average strip tensile strength.

Trapezoidal Tear Strength or "Trap" Tear Strength is a measure of the force required to propagate a tear in a nonwoven fabric, and was measured according to ASTM D 5733-99, and is reported in Newtons. The trap tear strength was measured for 5 samples in both the machine direction and the cross-direction. The average MD and average XD trap tear strengths were calculated and then averaged to obtain the average trap tear strength.

Frazier Air Permeability is a measure of air flow passing through a sheet under at a stated pressure differential between the surfaces of the sheet and was conducted according to ASTM D 737 using a pressure differential of 125 kPa, which is hereby incorporated by reference, and is reported in $m^3/min\text{-}m^2$.

Shore D Hardness is a measure of rubber hardness and is measured according to ASTM D 2240, which is hereby incorporated by reference.

The Melting Point of a polymer as reported herein is measured by differential scanning calorimetry (DSC) according to ASTM D3418-99, which is hereby incorporated by reference, and is reported as the peak on the DSC curve in degrees Centigrade. The melting point was measured using polymer pellets and a heating rate of 10° C. per minute.

Thickness of a nonwoven fabric was measured according to ASTM D-5729-97, which is hereby incorporated by reference.

Polymer Density is measured according to ASTM D1505-98e1. Polymer density of multicomponent fibers comprising polymeric components "A" and "B" can be calculated as $$= \frac{\rho_A \cdot \rho_B}{x_A \cdot (\rho_B - \rho_A) + \rho_A}$$

where $x_A$ is weight fraction of polymer "A", $\rho_A$ is the density of polymer "A", and $\rho_B$ is the density of polymer "B". The above formula can also be used to obtain density of blend of two polymers.

Void Percent was calculated per the following formula:

$$\text{Void } \% = \left[1 - \frac{\left(\frac{\text{Basis Weight}}{\text{Polymer Density}}\right)}{\text{Nonwoven Thickness}}\right] \times 100\%.$$

EXAMPLES

Examples 1-4

Examples 1 through 4 demonstrate preparation of full-surface bonded bicomponent polyester spunbond nonwoven fabrics according to the present invention using a smooth-calendering process to full-surface bond the fabrics.

Spunbond bicomponent nonwoven sheets were prepared in which the fibers were continuous core/sheath fibers having a poly(ethylene terephthalate) (PET) core component and a co-polyester sheath component. The PET core component was Crystar® polyester (Merge 4405, available from E. I. du Pont de Nemours and Company, Wilmington, Del.) having an intrinsic viscosity of 0.61 dl/g (as measured in U.S. Pat. No. 4,743,504, which is hereby incorporated by reference) and a melting point of about 260° C. The PET resin was dried in a through-air drier at a air temperature of 120° C., to a polymer moisture content of less than 50 parts per million. The co-polyester polymer used in the sheath component was Crystar® co-polyester which is a 17 mole percent modified dimethyl isophthalate PET copolymer (Merge 4446, available from E. I. du Pont de Nemours and Company, Wilmington, Del.) having a melting point of 230° C. The co-polyester resin was dried in a through-air drier at a temperature of 100C, to a polymer moisture content of less than 50 ppm. The PET polymer was heated to 290° C. and the co-polyester polymer was heated to 275° C. in separate extruders. The two polymers were separately extruded and metered to a spin-pack assembly, where the two melt streams were separately filtered and then combined through a stack of distribution plates to provide multiple rows of core-sheath cross-section fibers wherein the PET polyester component formed the core and the co-polyester component formed the sheath.

The spin-pack assembly consisted of a total of 2016 round capillary openings (28 rows of 72 capillaries in each row). The width of the spin-pack in the machine direction was 11.3 cm, and in the cross-direction was 50.4 cm. Each of the capillaries had a diameter of 0.35 mm and length of 1.40 mm. The spin-pack assembly was heated to 295° C. and the polymers were spun through the each capillary at a polymer throughput rate of 0.5 g/hole/min. The co-polyester sheath component made up 40 weight percent of the fibers. The spunbond fibers were cooled in a cross-flow quench extending over a length of 19 inches (48.3 cm). The attenuating force was provided to the bundle of spunbond fibers by a rectangular slot jet. The distance between the spin-pack to the entrance to the jet was 25 inches (63.5 cm).

The fibers exiting the jet were collected on a forming belt. Vacuum was applied underneath the belt to help pin the bicomponent spunbond fibers to the belt. The belt speed was adjusted to yield the desired nonwoven sheet basis weight. The fibers were then lightly thermally bonded between a set of embosser roll and anvil roll. Both bonding rolls were heated to a temperature of 145° C. roll temperature and a nip pressure of 100 lb/linear inch (17.5 N/mm) was used. This provided a very light thermal bonding to enable the sheet to be collected in rolls on a winder and handled in subsequent processing. The nonwoven spunbond webs prepared in Examples 1 and 3 had a basis weight prior to calendering of 65 g/m$^2$ and the nonwoven spunbond webs prepared in Examples 2 and 4 had a basis weight prior to calendering of 85 g/m$^2$.

The nonwoven webs were then smooth-calendered using the process shown in FIG. 1 to fully bond both sides of the fabric. The sheet was passed over change-of-direction roll 1 and around stainless steel pre-heating roll 3 to pre-heat the first side of the spunbond fabric prior to passing the spunbond nonwoven fabric through a nip formed by calender rolls 5 and 7. Calender roll 5 was a smooth stainless steel roll that was heated to the same temperature as pre-heating roll 3. Calender roll 7 was a smooth, unheated composite roll having a Shore D hardness of 90. In Examples 1 and 2, the pre-heating roll and the heated calender roll were both heated to 190° C. (40° C. below the melting point of the co-polyester polymer). In Examples 3 and 4, the pre-heating roll and the heated calender roll were both heated to 170° C. (60° C. below the melting point of the co-polyester). The calender line speed was 50 ft/min (15.4 m/min) and the nip pressure was 400 lbs/linear inch (70 N/mm). The second side of the fabric was bonded by making a second pass through the calender with the fabric inverted such that the second side contacted the pre-heating roll. Properties of the calendered nonwoven sheets are reported in Table 1 below.

TABLE I

Properties of Full-Surface Bonded Nonwoven Sheets

| Ex. No. | Fiber Type | Thickness (mm) | Thickness/BW (mm/gsm) | Void (%) | Frazier (m$^3$/min-m$^2$) | MD Strip Tensile (N) | XD Strip Tensile (N) | Avg Strip Tensile/BW (N/gsm) | MD Trap Tear (N) | XD Trap Tear (N) | Avg Trap Tear/BW (N/gsm) |
|---|---|---|---|---|---|---|---|---|---|---|---|
| 1 | Sheath/core | 0.079 | 0.0012 | 40.55 | 5.46 | 150.8 | 45.8 | 1.51 | 16.5 | 29.4 | 0.353 |
| 1A | Mixed Single component | 0.117 | 0.0018 | 59.94 | 13.45 | 71.6 | 6.7 | 0.60 | 13.8 | 20.9 | 0.266 |
| 2 | Sheath/core | 0.105 | 0.0012 | 41.14 | 0.28 | 185.9 | 65.4 | 1.48 | 23.6 | 41.4 | 0.382 |
| 2A | Mixed Single component | 0.140 | 0.0016 | 55.91 | 7.81 | 103.6 | 25.4 | 0.76 | 22.7 | 32.9 | 0.327 |

TABLE I-continued

Properties of Full-Surface Bonded Nonwoven Sheets

| Ex. No. | Fiber Type | Thickness (mm) | Thickness/BW (mm/gsm) | Void (%) | Frazier ($m^3$/min-$m^2$) | MD Strip Tensile (N) | XD Strip Tensile (N) | Avg Strip Tensile/BW (N/gsm) | MD Trap Tear (N) | XD Trap Tear (N) | Avg Trap Tear/BW (N/gsm) |
|---|---|---|---|---|---|---|---|---|---|---|---|
| 3 | Sheath/core | 0.091 | 0.0014 | 48.81 | 8.28 | 118.3 | 28.9 | 1.13 | 20.9 | 52.9 | 0.568 |
| 3A | Mixed Single component | 0.160 | 0.0025 | 70.75 | 13.73 | 63.6 | 5.3 | 0.53 | 7.1 | 29.4 | 0.281 |
| 4 | Sheath/core | 0.127 | 0.0015 | 51.50 | 3.26 | 148.6 | 43.6 | 1.13 | 29.8 | 65.4 | 0.560 |
| 4A | Mixed Single component | 0.193 | 0.0023 | 68.09 | 8.22 | 90.3 | 19.1 | 0.64 | 16.9 | 42.3 | 0.348 |
| 9A | Sheath/core | 0.116 | 0.0015 | 49.96 | 1.18 | 198.4 | 98.8 | 1.86 | 1.33 | 2.27 | 0.023 |

Comparative Examples 1A -4A

Comparative Examples 1A through 4A demonstrate preparation of full-surface bonded polyester spunbond nonwoven fabrics made from a mixture of single component filaments (instead of bicomponent filaments used in Examples 1-4) using a smooth-calendering process to full-surface bond the fabrics.

Lightly bonded spunbond nonwoven sheets were prepared according to the process described in Examples 1-4 except that the spin-pack used was a mixed fiber pack designed to spin a mixture of single component fibers. The spin-pack assembly consisted a total of 2016 round capillary openings (28 rows of 72 capillaries in each row). The width of the spin-pack in machine direction was 11.3 cm, and in cross-direction was 50.4 cm. Each of the polymer capillary had a diameter of 0.35 mm and length of 1.40 mm. The three outside rows in the machine direction produced single component fibers with the same co-polyester used in Examples 1-4. The remaining 22 middle rows produced single component fibers with PET. The throughput per hole of PET polymer was 0.5 g/min. The throughput rate of co-polyester component was adjusted to yield a sheet that was 40 weight percent of the co-polyester fibers based on the total weight of the nonwoven sheet.

The collecting belt speed was adjusted to yield the desired nonwoven sheet basis weight. The nonwoven spunbond webs prepared in Examples 1A and 3A had a basis weight prior to calendering of 65 g/$m^2$ and the nonwoven spunbond webs prepared in Examples 2A and 4A had a basis weight prior to calendering of 85 g/$m^2$.

The spunbond webs were then full-surface bonded using the smooth-calendering process described above for Examples 1-4. In Examples 1A and 2A, the pre-heating roll and the heated calender roll were both heated to 190° C. (40° C. below the melting point of the co-polyester polymer). In Examples 3A and 4A, the pre-heating roll and the heated calender roll were both heated to 170° C. (60° C. below the melting point of the co-polyester polymer). The calender line speed was 50 ft/min (15.4 m/min) and the nip pressure was 400 lbs/linear inch (70 N/mm). Properties of the calendered spunbond nonwoven sheets are reported above in Table 1.

The results shown in Table 1 demonstrate that the full-surface bonded nonwoven webs of the present invention, prepared from bicomponent spunbond nonwoven webs, have much higher ratios of average strip tensile strength to basis weight, lower ratios of thickness to basis weight (lower void %), and higher ratios of average trap tear strength to basis weight than the corresponding comparative examples that were prepared from a mixture of two different single component fibers wherein the two different single component fibers are made from the same individual polymers used in the sheath and the core of the bicomponent fibers of the examples of the present invention. The examples prepared according to the present invention also have significantly lower Frazier air permeability than the corresponding comparative examples.

Comparative Examples 5A -8A

These Examples demonstrate the preparation of point-bonded bicomponent sheath-core spunbond nonwovens.

Lightly bonded spunbond webs were prepared according to the process described in Examples 1-4. The speed of the collecting belt was adjusted such that Comparative examples 5A and 7A had a basis weight of 65 g/$m^2$ and Comparative Examples 6A and 8A had a basis weight of 85 g/$m^2$. The webs were then thermally point bonded using a nip formed by an oil-heated embosser roll and a smooth oil-heated anvil roll. The embosser roll had a chrome coated non-hardened steel surface with a diamond pattern having a point size of 0.466 $mm^2$, a point depth of 0.86 mm, a point spacing of 1.2 mm, and a bond area of 14.6%. The smooth anvil roll had a hardened steel surface. For Examples 5A and 6A both bonding rolls were heated to 145° C. (85° C. below the melting point of the co-polyester polymer) and for examples 7A and 8A, both bonding rolls were heated to 160° C. (70° C. below the melting point of the co-polyester polymer). The bonding pressure used was 70 N/mm for each of these examples and the bonding line speed was 50 ft/min (15.4 m/min).

Properties of the point-bonded bicomponent spunbond nonwoven sheets are reported below in Table 2. The point-bonded nonwovens of Comparative Examples 5A-8A have significantly lower ratios of average trap tear strength to basis weight and average strip tensile strength to basis weight than the full-surface bonded materials of the present invention. The point-bonded bicomponent spunbond materials also had significantly higher void percent than the materials of the present invention, making them unsuitable for end uses requiring smooth, dense structures.

Comparative Example 9A

This Example demonstrates the preparation of a full-surface bonded bicomponent (sheath/core) polyester spunbond fabric that was calendered at a temperature of 20° C. below the melting point of the polyester copolymer sheath.

A lightly bonded bicomponent spunbond nonwoven fabric having a basis weight of 80 g/$m^2$ and comprising poly(ethylene terephthalate) co-polymer sheath/poly(ethylene terephthalate) core fibers was prepared as described above for Examples 1-4.

The lightly bonded spunbond web was smooth-calendered using the method described above for Examples 1-4 except that the pre-heating roll and heated calender roll were both heated to 210° C. (20° C. below the melting point of the co-polyester copolymer). Properties of the calendered sheet are reported in Table 1 above. The full-surface bonded fabric of Comparative Example 9 had significantly lower average trap tear/basis weight than the examples of the present invention.

TABLE 2

Properties of Point-Bonded Nonwoven Sheets

| Ex. No. | Thickness (mm) | Thickness/ BW (mm/gsm) | Void (%) | Frazier ($m^3$/min-$m^2$) | MD Strip Tensile (N) | XD Strip Tensile (N) | Avg Strip Tensile/BW (N/gsm) | Trap Tear MD (N) | Trap Tear XD (N) | Avg Trap Tear/BW (N/gsm) |
|---|---|---|---|---|---|---|---|---|---|---|
| 5A | 0.305 | 0.0430 | 84.64 | 36.3 | 71.2 | 31.1 | 0.78 | 26.7 | 52.5 | 0.59 |
| 6A | 0.381 | 0.0408 | 83.83 | 25.1 | 89.0 | 43.1 | 0.78 | 35.6 | 62.3 | 0.56 |
| 7A | 0.290 | 0.0408 | 83.83 | 40.3 | 70.7 | 38.3 | 0.85 | 26.2 | 43.6 | 0.52 |
| 8A | 0.356 | 0.0.0381 | 82.68 | 28.1 | 91.6 | 54.3 | 0.86 | 34.7 | 54.3 | 0.51 |

What is claimed is:

1. A full-surface bonded multiple component nonwoven fabric comprising a full-surface bonded nonwoven sheet consisting of melt-spun multiple component fibers selected from the group consisting of multiple component staple fibers, multiple component continuous fibers, and combinations thereof, the multiple component fibers having a cross-section and a length, and comprising a first polymeric component and a second polymeric component, the first and second polymeric components being arranged in substantially constantly positioned distinct zones across the cross-section of the multiple component fibers and extending substantially continuously along the length of the multiple component fibers, wherein the second polymeric component has a melting point that is at least about 10° C. lower than the melting point of the first polymeric component and wherein at least a portion of the outer peripheral surface of the multiple component filaments comprises the second polymeric component, a ratio of average strip tensile strength to basis weight of at least 1.05 N/gsm, and a ratio of average trap tear strength to basis weight of at least 0.329 N/gsm.

2. The full-surface bonded multiple component nonwoven fabric of claim 1 which has a void percent between about 3% and 56%.

3. The full-surface bonded multiple component nonwoven fabric of claim 1 which has a Frazier air permeability of at least 0.155 $m^3$/ min-$m^2$.

4. The full-surface bonded multiple component nonwoven fabric of claim 1 wherein the melt-spun multiple component fibers consist of multiple component continuous spunbond fibers.

5. The full-surface bonded multiple component nonwoven fabric of claim 4 wherein the multiple component continuous fibers have a cross-section selected from the group consisting sheath-core and side-by-side configurations.

6. The full-surface bonded multiple component nonwoven fabric of claim 5 wherein the continuous multiple component continuous fibers have a sheath-core cross-section wherein the first polymeric component forms the core and the second polymeric component forms the sheath.

7. The full-surface bonded multiple component nonwoven fabric of claim 6 wherein the first polymeric component comprises a polymer selected from the group consisting of poly (ethylene terephthalate) and poly(hexamethylene adipamide), and the second polymeric component comprises a polymer selected from the group consisting of poly(ethylene terephthalate) copolymers, poly (1,4-butylene terephthalate), poly(1,3-propylene terephthalate), and polycaprolactam.

8. The full-surface bonded multiple component nonwoven fabric of claim 7 wherein the first polymeric component comprises poly(ethylene terephthate) and the second polymeric component comprises a poly(ethylene terephthalate) copolymer.

9. The full-surface bonded multiple component nonwoven fabric of claim 8 wherein the poly(ethylene terephthalate) copolymer is selected from the group consisting of poly(ethylene terephthalate) copolynmers comprising between about 5 and 30 mole percent di-methyl isophthalio acid based on total diacid units in the copolymer and poly(ethylene terephthalate) copolymers comprising between about 6 and 60 mole percent 1,4-cyclohexanedimethanol based on total glycol units in the copolymer.

10. The full-surface bonded multiple component fabric of claim 1 wherein the melt-spun multiple component fibers consist of multiple component staple fibers.

11. The full-surface bonded multiple component nonwoven fabric of claim 1 wherein the void percent is between about 35% and 55%.

12. A multi-layer composite sheet comprising at least one full-surface bonded multiple component nonwoven fabric according to claim 1 adhered to at least one sheet layer selected from the group consisting of nonwoven webs and films.

13. The multi-layer composite sheet of claim 12 wherein the full-surface bonded multiple component nonwoven fabric consists of multiple component continuous fibers and the sheet layer comprises a meltblown web.

14. The multi-layer composite sheet of claim 13 further comprising a second full-surface bonded multiple component nonwoven fabric according to claim 1 consisting of multiple component continuous fibers, wherein the meltblown web is sandwiched between and adhered to the first and second full-surface bonded multiple component nonwoven fabrics.

15. A process for preparing a thermally bonded multiple component nonwoven fabric comprising the steps of:

a. providing a multiple component nonwoven fabric having a first outer surface and an opposing second outer surface, the multiple component nonwoven fabric consisting of multiple component melt-spun fibers selected from the group consisting of multiple component staple fibers, multiple component continuous fibers, and combinations thereof, the multiple component fibers having a cross-section and a length, and comprising a first polymeric component and a second polymeric component, the first and second polymeric components being arranged in substantially constantly positioned distinct zones across the cross-section of the multiple component fibers and extending substantially continuously along the length of the multiple component fibers, wherein the second polymeric component has a melting point, $T_m$, that is at least about 10° C. lower than the melting point of first polymeric component and at least a portion of the outer peripheral surface of the multiple component filaments comprises the second polymeric component;

b. pre-heating the first and second outer surfaces of the multiple component nonwoven fabric to a temperature between 35° C. and ($T_m$-40)° C.;

c. full-surface bonding the first outer surface of the nonwoven fabric by passing the pre-heated nonwoven fabric through a first nip formed by first and second smooth-surfaced calender rolls wherein the second roll is unheated and the first roll contacts the first outer surface of the nonwoven fabric and is maintained at a temperature no greater than ($T_m$-40)° C., while applying a nip pressure between about 17.5 to about 70 N/mm; and d. full-surface bonding the second outer surface of the nonwoven fabric by passing the nonwoven fabric through a second nip formed by third and fourth smooth-surfaced calender rolls wherein the fourth roll is unheated and the third roll contacts the second outer surface of the nonwoven fabric and is maintained at a temperature no greater than ($T_m$-40)° C. while applying a nip pressure between about 17.5 to about 70 N/mm.

16. A process for preparing a thermally bonded multiple component nonwoven fabric comprising the steps of:

a. providing a multiple component nonwoven fabric having a first outer surface and an opposing second outer surface, the multiple component nonwoven fabric consisting of multiple component melt-spun fibers selected from the group consisting of multiple component staple fibers, multiple component continuous fibers, and combinations thereof the multiple component fibers having a cross-section and a length, the multiple component fibers comprising a first polymeric component and a second polymeric component, the first and second polymeric components being arranged in substantially constantly positioned distinct zones across the cross-section of the multiple component fibers and extending substantially continuously along the length of the multiple component fibers, wherein the second polymeric component has a melting point, $T_m$, that is at least about 10° C. lower than the melting point of first polymeric component and at least a portion of the outer peripheral surface of the multiple component filaments comprises the second polymeric component;

b. pre-heating the first outer surface of the multiple component nonwoven fabric to a temperature between 35° C. and ($T_m$−40)° C.;

c. full-surface bonding the first outer surface of the multiple component nonwoven fabric by passing the pre-heated nonwoven fabric through a first nip formed by first and second smooth-surfaced calender rolls wherein the second roll is unheated and the first roll contacts the first outer surface of the nonwoven fabric and Is maintained at a temperature no greater than ($T_m$-40)° C.;, while applying a first nip pressure between about 17.5 to about 70 N/mm;

d. pre-heating the second outer surface of the multiple component nonwoven fabric to a temperature between 35° C. and ($T_m$-40)° C.; and e. full-surface bonding the second outer surface of the nonwoven fabric by passing the twice pre-heated nonwoven fabric through a second nip formed by third and fourth smooth-surfaced calender rolls wherein the fourth roll is unheated and the third roll contacts the second outer surface of the nonwoven fabric and is maintained at a temperature no greater than ($T_m$-40)° C., while applying a second nip pressure between about 17.5 to about 70 N/mm.

17. A full-surface bonded nonwoven fabric prepared according to the process of either of claims 15 or 16 wherein the full-surface bonded nonwoven fabric has a void percent between 3% and 56%. a ratio of average strip tensile strength to basis weight of at least 1.05 N/gsm, a Frazier air permeability of at least 0.155 $m^3$/ min-$m^2$ , and a ratio of average trap tear strength to basis weight of at least 0.329 N/gsm.

18. The full-surface bonded nonwoven fabric of claim 17 wherein the void percent is between about 35% and 55%.

19. The full-surface bonded nonwoven fabric of either of claims 1 or 18 wherein the Frazier air permeability is at least 0.310 $m^3$/ min-$m^2$.

* * * * *